United States Patent [19]

Brouse et al.

[11] Patent Number: 4,739,700

[45] Date of Patent: Apr. 26, 1988

[54] SEAL-LESS STRAPPING HEAD

[75] Inventors: S. Bernard Brouse, Orland Park; John Wiedel, Chicago, both of Ill.

[73] Assignee: U.S. Steel Supply Inc., Chicago, Ill.

[21] Appl. No.: 947,807

[22] Filed: Dec. 30, 1986

Related U.S. Application Data

[63] Continuation of Ser. No. 779,323, Sep. 23, 1985, abandoned.

[51] Int. Cl.[4] ..... B65B 3/30

[52] U.S. Cl. ..... 100/29

[58] Field of Search ..... 100/26, 29, 30, 32; 140/93.2

[56] References Cited

U.S. PATENT DOCUMENTS

| | | | |
|---|---|---|---|
| 3,545,499 | 12/1970 | Dalton et al. | 100/93.2 |
| 3,794,086 | 2/1974 | Hall et al. | 100/93.2 |
| 3,804,001 | 4/1974 | Longerich et al. | 100/4 |
| 4,164,176 | 8/1979 | Brouse | 100/26 X |
| 4,527,379 | 7/1985 | Bartzick et al. | 100/29 X |

*Primary Examiner*—Andrew M. Falik

*Attorney, Agent, or Firm*—Welsh & Katz, Ltd.

[57] ABSTRACT

A seal-less strapping head having an improvement for deflecting an angularly inclined overlying portion of the strap downwardly to prevent premature cut-off of the strap before the overlapped portions are fastened together. Apparatus is also provided for adjusting the elevation of the shear blade with respect to the movable die to accommodate severing a wide range of strap thicknesses. In another aspect, first and second frame sections are pivotally attached, the first section having cylinder means mounted thereon, the second section having cylinder means mounted thereon, the second section having a pair of dies housed therein for fastening the strap. Apparatus is provided for rotating the cylinder rod to vary the length engagement of a threaded member with a threaded portion extending axially from the cylinder rod to adjust the stroke of the upper die for various strap thicknesses.

2 Claims, 6 Drawing Sheets

SEAL-LESS STRAPPING HEAD

This application is a continuation of application Ser. No. 779,323, filed 9/23/85 abandoned.

TECHNICAL FIELD

This invention relates to a seal-less head for strapping machines, and particularly to improvements in a pinch-off type shear utilized with such heads for preventing premature cut-off of the strap and also for providing adjustment of this type of shear. It also relates to improvements for disengaging the dies from the strap, providing adjustment and ready replacement of the dies, as well as preventing die overtravel and the resultant damage to the dies caused thereby.

BACKGROUND ART

Conventional strapping machines feed a strip of strapping material around an article forming an overlapped portion of the strap, after which the strap is tensioned and the overlapped portions are fastened together and a feed portion is severed from the loop fastened about the article. The overlapped portions may be fastened by methods involving either (i) crimping a separate sealing member onto the overlapped portions or (ii) die-cut notching the overlapped portions of the strap. This latter method is commonly known as the seal-less method because a separate sealing member is not used.

An example of an automatic seal-less head type of strapping machine is shown in U.S. Pat. No. 3,804,001. This head utilizes a cutter blade and cooperating anvil to sever the strap after the overlapped portions are notched and fastened together by the dies. The dies are actuated in sequence by a rotary cam shaft, the last die actuated carrying the cutter blade for severing the strap. This mechanism assures that the overlapping strap is fastened before the feed portion is severed from the loop. However, the mechanism required is complicated and includes many bearings, cams and other parts to accomplish this function. A simpler mechanism for actuation of the dies is shown in U.S. Pat. No. 3,794,086. A hydraulic cylinder actuates all the dies and the shear blade simultaneously. A problem with this design can arise from premature severing of the strap if there is a space between the feed portion of the strap and the underlying strap portion at the location of the shear blade. This space results from the close position of the feed rollers with respect to the seal-less head which necessities feeding the strap through an entry guide aligned at an inclined angle with respect to the seal-less head. An example of such a configuration is shown in U.S. Pat. No. 3,804,001. Of course, it is desirable to have the feed mechanism positioned close to the head to provide a compact machine. To eliminate an angularly aligned entry guide would require remote positioning of the feed rollers so that a horizontal entry could be obtained at the location of the head. Another problem is that no provision is made for shearing different thicknesses of strap. The shears are set for severing a narrow range of strap thicknesses upon assembly of the machine and cannot be adjusted for severing other strap thicknesses without shutdown and disassembly of the machine.

It is known to provide for tilting of the head to remove the dies from the strap after the overlapped portions are fastened together. This arrangement has the advantage of permitting the dies to be housed together as a unit in the head as distinguished from the split die arrangement shown in U.S. Pat. No. 3,794,086. The unitary arrangement, in turn, helps main proper die alignment which is critical for obtaining a securely fastened joint in the overlapped strap. However, prior designs have been rather complicated because of the tilting mechanisms. For example, the whole head and die-actuating mechanism is tilted in the design shown in U.S. Pat. No. 3,545,499. U.S. Pat. No. 3,804,001 shows tilting of the head and feed mechanism, although not the motor for actuating the dies. Another disadvantage of the prior designs is that a separately actuated tilting mechanism was required.

Finally, prior seal-less head designs contain provision for adjusting the spacing of the dies over only a narrow range. Such heads are not able to handle as wide a range of strap thicknesses as desired. Furthermore, the adjustment was made on a trial-and-error basis, requiring independent measurement of the die spacing after each adjustment.

DISCLOSURE OF INVENTION

According to this invention, the improved seal-less strapping machine comprises means for deflecting the overlapping portion of the strap toward the underlying strap portion at the location of a pinch-off shear so as to prevent premature cut-off of the strap before the overlapped strap portions are secured together. In another aspect of the invention, means are provided for adjusting a pinch-off shear blade to accommodate the need for severing a wide range of strap thicknesses from the fastened loop of strap extending around an article. In another aspect, separate first and second frame sections are pivotally connected together. A pair of dies for forming the seal-less joint are mounted in a first of the frame sections and cylinder means for actuating the dies is mounted on the second frame section. Means connected to and reciprocable with the cylinder rod provides pivotal movement of the first frame section in an arc generally tangent to mateable facing surfaces of a slidable die and the other die upon a stroke of a cylinder rod away from the other die, disengaging the dies from the strap. In a final aspect, threaded means for adjusting the spacing of the dies connects the cylinder rod to the slidable die and means is provided for locking the threaded adjustment means in the various selected positions thereof.

BEST MODE FOR CARRYING OUT THE INVENTION

Figure 1:
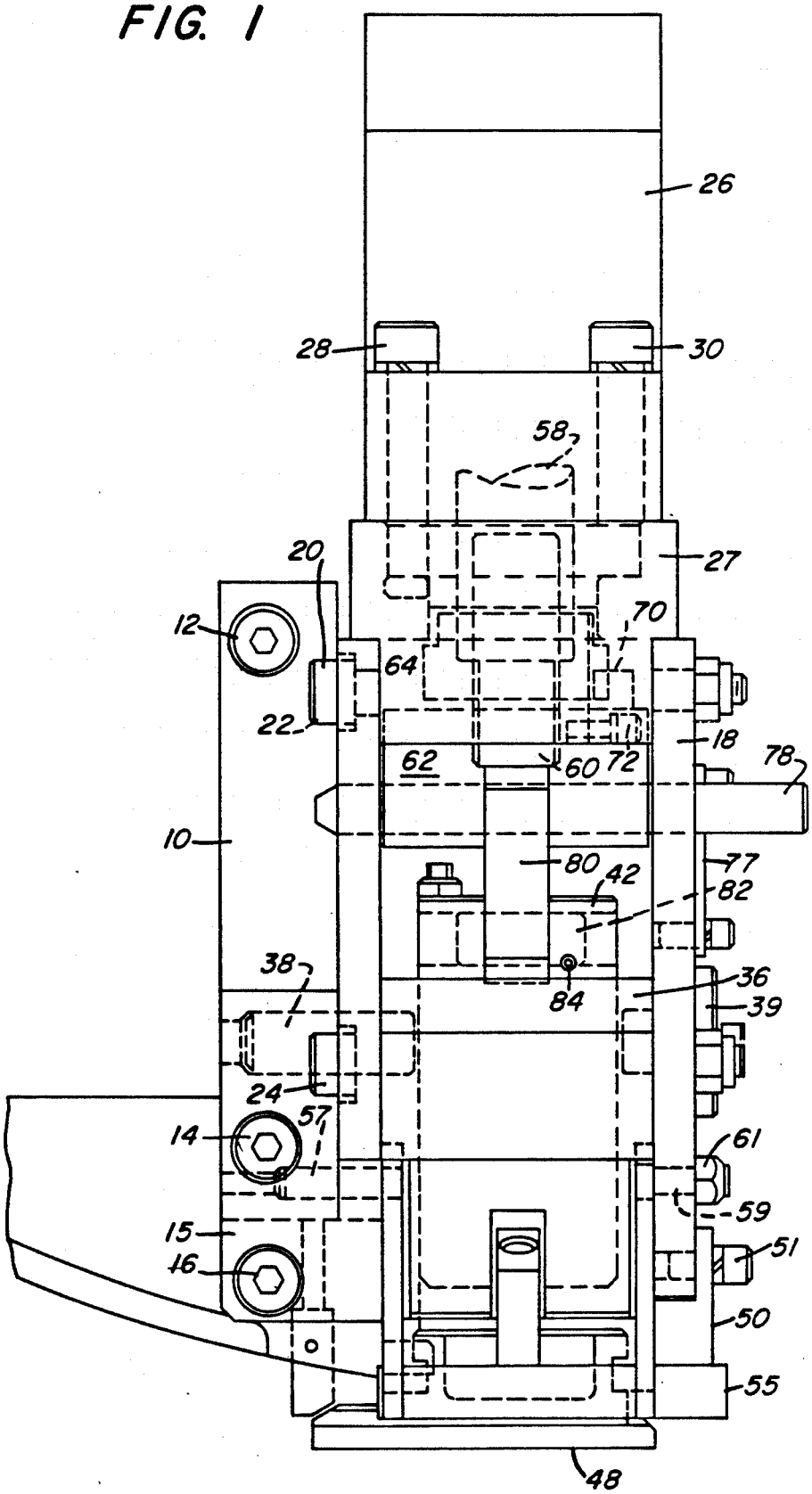
FIG. 1 is a front elevation view of a seal-less punch assembly showing the improvements of the present invention.
Figure 2:
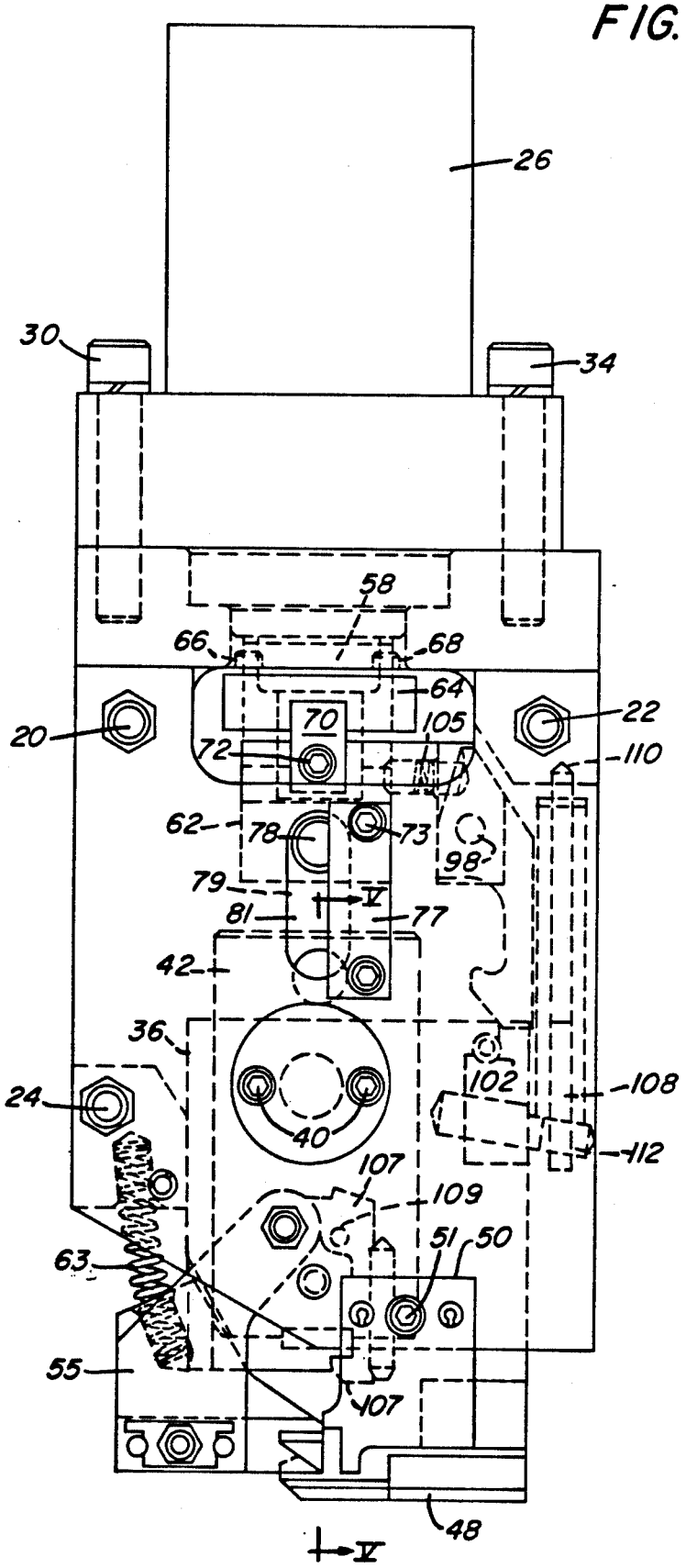
FIG. 2 is a side elevation view of the punch assembly shown in FIG. 1.

Machines for applying strapping material around an article and seal-lessly fastening an overlapped portion of the strap are shown in U.S. Pat. Nos. 3,545,499 and 3,804,001, the specifications of which are incorporated herein by reference. The improvements of this invention relate to the head or punch assembly of such machines for seal-lessly fastening the strap. Referring to FIGS. 1 and 2, the punch assembly includes a first frame section which comprises a mounting plate 10 that is secured to the machine (not shown) by allen head bolts 12 and 14 and a side plate 18 which is secured to the mounting plate by bolts 20, 22 and 24 with corresponding nuts thereon. An upper strap guide block 15 abutted against a lower edge of the mounting plate is secured to the machine by bolt 16. A hydraulic cylinder 26 is mounted on a top plate 27 which is fastened between mounting plate 10 and side plate 18. Bolt 20 passes through mateably aligned bores in mounting plate 10, side plate 18 and top plate 17. Cylinder 26 is secured to the top plate by four stud bolts 28, 30, 32 and 34.

Figure 5:
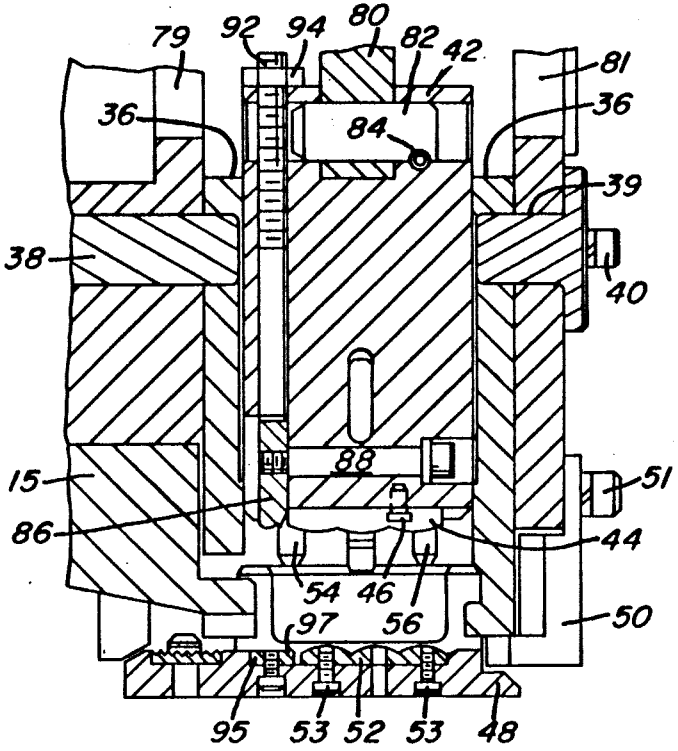
FIG. 5 is a section taken at V—V of FIG. 2.
Figure 3:
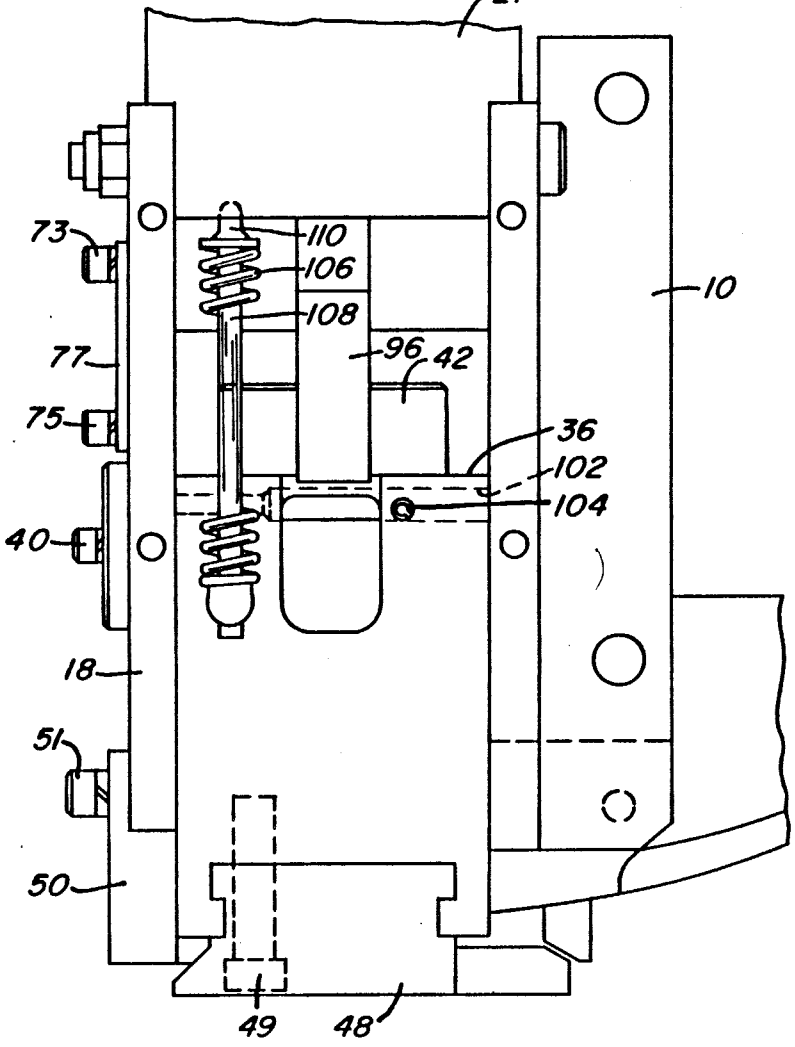
FIG. 3 is a rear view of the punch assembly shown in FIG. 1.
Figure 4:
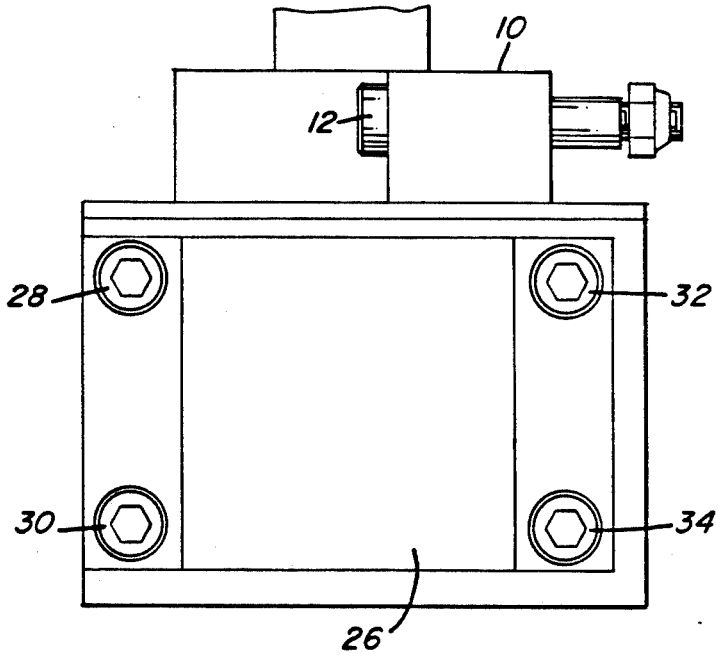
FIG. 4 is a top view of the punch assembly of FIG. 1.
Figure 6:
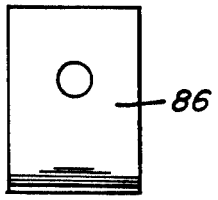
FIG. 6 is a front elevation view of the pinch-off shear blade.
Figure 7:
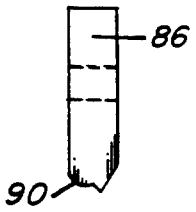
FIG. 7 is a side elevation view of the shear blade shown in FIG. 6.

According to one aspect of this invention, a second frame section 36 is pivotally mounted between mounting plate 10 and side plate 18 by cylindrical shaft 38 (FIG. 5) and a pin 39 having a flanged end secured to side plate 18 by allen head screws 40 (FIGS. 2 and 5). The axis of rotation of the second frame section is displaced slightly from the centerline of the dies described below so that forces exerted on the dies do not move the frame out of position accidentally. The second frame section has a cylindrical bore therethrough for slidably receiving a piston 42 therein. Returning to conventional aspects of the design (FIG. 5), a die plate 44 is secured to the lower end of the piston by a plurality of screws, one of which is shown as 46. A shoe 48 is secured to the second frame section by two screws, one of which is shown as 49 (FIG. 3). A strap guide 50 is secured to the first frame section by screw 51 (FIGS. 2, 3 and 5). A die plate 52 is secured to the shoe by two screws 53 (FIG. 5). A pair of leader pins 54 and 56 extend downwardly from piston 42 so as to engage bores (not shown) in the shoe 48 and guide movement of the upper die with respect to the lower die and prevent it from becoming misaligned with respect to the lower die. A strap guide 55 is pivotally attached to the side plate by dowel pin 57 and bolt 59 (FIG. 1) secured by nut 61. A compression spring 63 allows the strap guide to pivot out of the path of the upper die on its downward stroke in a manner described in U.S. Pat. No. 4,164,176, the specification of which is incorporated herein by reference.

Figure 12:
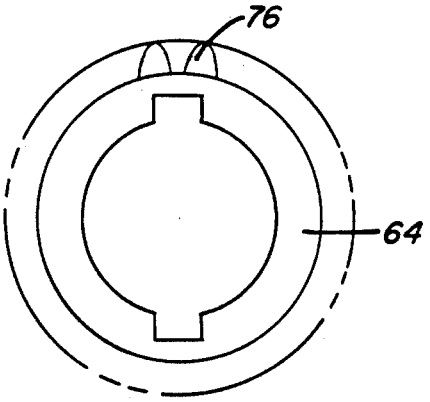
FIG. 12 is a plan view of the gear for adjustment of the spacing between the dies.
Figure 13:
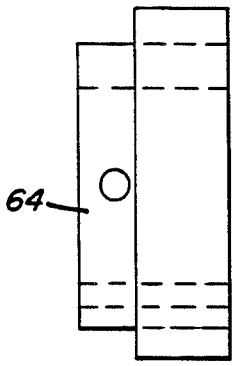
FIG. 13 is a side elevation view of the gear shown in FIG. 12.
Figure 14:
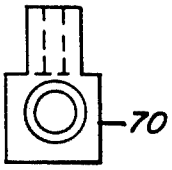
FIG. 14 is a front view of means for locking the position of the adjustment gear of FIG. 12.
Figure 15:
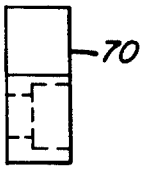
FIG. 15 is a side elevation view of the locking means shown in FIG. 14.
Figure 16:
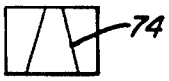
FIG. 16 is a plan view of the locking means shown in FIG. 14.

The hydraulic cylinder has a reciprocable and rotatable cylinder rod 58, at one end having a threaded bore therein. A stud 60 is threadedly engaged in the bore of the cylinder rod at one end and secured in a threaded bore of a cylinder attachment block 62 by a roll pin key (not shown) at the other end. The cylinder attachment block 62 is slidably mounted between the mounting plate 10 and side plate 18. In another aspect of the invention, a gear adjustment wheel 64 (FIGS. 1, 2, 12, 13 and 17) is mounted on the cylinder rod 58. A pair of set screws 66 and 68 (FIGS. 2 and 17) secure the gear adjustment wheel to diametrically opposed flat surfaces on the outer surface of the cylinder rod. The wheel has a bore with a smooth surface of larger diameter than the outer diameter of the threaded stud. A locking plate 70 is secured to cylinder attachment block 62 by bolt 72 (FIGS. 1 and 2). The locking plate has a tapered portion 74 (FIG. 16) for engaging the spaces between teeth 76 (FIG. 12) of the gear adjustment wheel 64. A pin 78 extends through mateably aligned bores in spaced arm portions of the cylinder attachment block 62 and through a bore adjacent one end of link 80. This pin is readily removable for facilitating removal and replacement of piston 42 and the die contained thereon. A pin 82 extends through a bore adjacent the lower end of link 80 and into mateably aligned bores in an upper portion of piston 42. Pin 82 is secured in position by a key 84. The pin 78 may be removed by first moving allen head screws 73 and 75 (FIG. 2) and keeper plate 77. This feature is especially important on a high cycle rate automatic strapping head because it facilitates quick removal of piston 42 and top die 44 mounted thereon for inspection or replacement. Pin 78 also extends through elongated mateably aligned slots 79 and 81 (FIGS. 2 and 5) in the mounting plate and the side plate, respectively. The lower rounded surface of each slot serves as a stop surface for limiting downward movement of the pin and cylinder attachment block in order to prevent overtravel of the upper die and damage to the lower die which would result therefrom. This feature is especially applicable where adjustment of the stroke of the upper die is provided.

Figure 8:
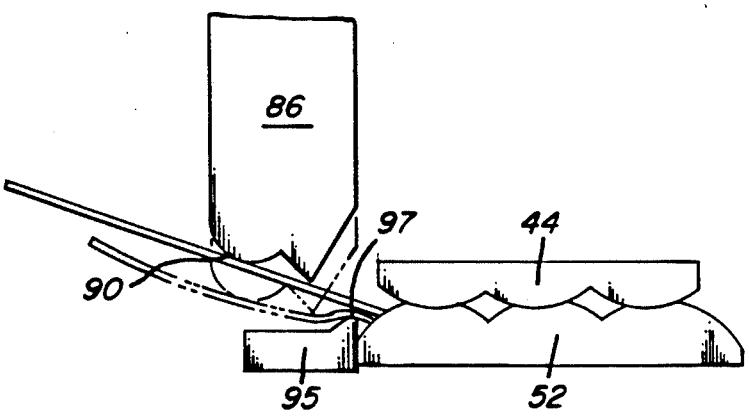
FIG. 8 is an enlarged side elevation view of a portion of the blade as shown in FIG. 7.
Figure 9:
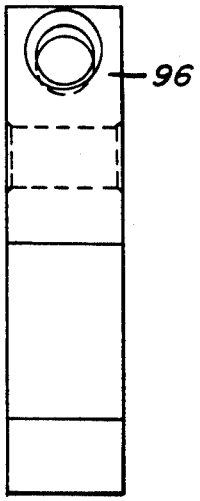
FIG. 9 is a front view of a hook for pivoting the lower frame section to disengage the dies from the strap.
Figure 10:
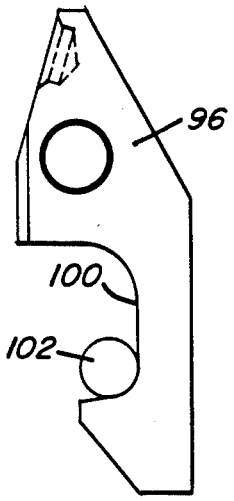
FIG. 10 is a side elevation view of the hook shown in FIG. 9.
Figure 11:
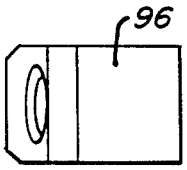
FIG. 11 is a top view of the hook shown in FIG. 8.

A pinch-off shear blade 86 is secured in the piston by a stud bolt 88 having a threaded end for engaging a threaded bore in blade 86. The blade has a conventional V-shaped cutting surface at the lower end thereof. In another aspect of the invention, the blade has a rounded protruding portion 90 (FIG. 8) adjacent to the cutting surface for deflecting the overlying overlapped portion of the strap downwardly toward the underlying strap portion sufficiently to prevent premature cut-off of the strap before the overlapped portions are secured together by the punch assembly. Another inventive aspect is provided by adjustment rod 92 having a threaded upper end secured in the piston and locked by nut 94. The upper end of the adjustment rod has a slot (not shown) adapted to receive the blade of a screw driver for turning the rod and adjusting the elevation of the cutting edge of the blade with respect to the die in order to accommodate cutting a wide range of strap thicknesses. A detent anvil 95 (FIGS. 5 and 8) has a recessed upper surface sloping upwardly to a lip 97. The lip and recessed portion cooperate with the shear blade to bend the severed end of the strap downwardly as a safety feature to eliminate the danger of personnel being cut by the sharp edge of the strap.

Figure 17:
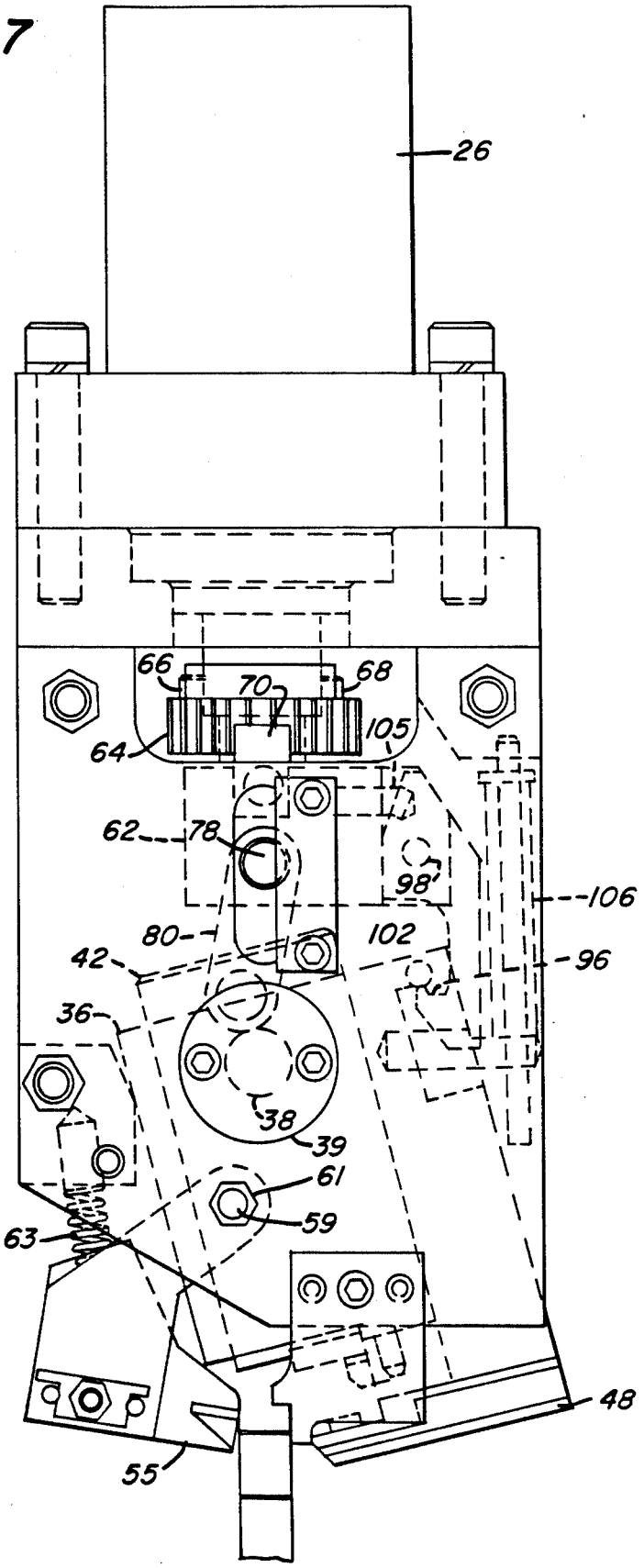
FIG. 17 is a side elevation view of the punch assembly similar to FIG. 2 showing the second frame section in an upwardly pivoted position.

In still another aspect of the invention, a hook 96 (FIGS. 2, 9–11 and 17) is pivotally attached to the cylinder attachment block 62 by pin 98. The hook has a C-shaped portion 100 for engaging a cylindrical pin 102 secured in a cutaway portion at the upper edge of second frame section 36 by roll pin 104. A compression spring 105 is mounted in a slot in the cylinder attachment block and engages a mateably aligned slot in the upper end of the hook to bias the hook toward a vertical alignment. The C-shaped portion of the hook is adapted to engage pin 102 upon downward movement of the cylinder attachment block 62 and pivot the second frame section 36 outwardly as shown in FIG. 17 on upward movement of the cylinder attachment block. A stripper hook 107 (FIG. 2) pivotally attached by pin 109 to the piston lifts the strap slightly on an upward stroke of the piston to disengage the strap from the lower die. The outward pivotal movement of the second frame section swings the dies away from the strap releasing the strap onto the article. A spring return is provided for pivoting the second frame section downwardly into position for fastening another overlapped strap portion. This includes spring 106 mounted on guide rod 108 and having a rounded cap 110 at an upper end of the rod which fits in a downwardly facing detented portion of a downwardly extending flange of the top plate. A pin 112 press fit into second frame section 36 has a protruding end portion with a bore for receiving the lower end of guide rod 108 therein. The guide rod has a flange resting on the upper surface of the protruding portion of pin 112. The protruding portion of the pin serves as a support for the lower end of the guide rod and spring 106.

In operation, flat strapping material is fed through a loop track extending around the periphery of an article so that a feed portion of the strap overlaps the underlying free end. The free end is then clamped and held while a tensioning means tightens the loop. The apparatus for performing these functions may be conventional type such as that illustrated in U.S. Pat. Nos. 3,545,499 and 3,804,001 mentioned previously. After tensioning of the strap, the punch assembly of this invention is actuated to secure the overlapped strap portions together. Cylinder 26 is activated to produce a downward stroke of the cylinder rod, lowering the piston and top die into engagement with the strap. The dies are designed for notching and interlocking the overlapped strap portion in conventional fashion. during the downward stroke, hook 96 engages pin 102 and is held thereagainst by spring 105. As the upper die approaches the lower die, the rounded portion 90 of the shear blade 86 contacts the feed portion of the strap deflecting it downwardly toward the underlying strap portion. On continued downward movement, the upper die contacts the strap notching and interlocking it, while shear blade 86 severs the feed portion of the strap from the fastening loop. Stop surfaces of slots 79 and 81 prevent overtravel of the upper die during the downward stroke. On a subsequent upward stroke of the cylinder rod, stripper hook 107 disengages the strap from the lower die 52 and second frame section 36 is pivoted outwardly swinging the dies from the strap and permitting release of the strap onto the article. Near the uppermost part of the cylinder stroke, hook 96 automatically disengages from pin 102 and spring 106 (FIG. 17) returns the second frame section to its original position completing the cycle.

Industrial Applicability

This invention is applicable to machines for seal-lessly securing flat strapping material around the periphery of an article, package or bundle. It is especially applicable to machines for applying metal strapping material to such articles, etc.

We claim:

1. In apparatus for seal-lessly fastening overlapped portions of strapping material together, said apparatus including a frame, a pair of mateable dies mounted in said frame for notching and interlocking the overlapped strap portions, at least one of said dies being slidably movable with respect to the other in a direction normal to mateable facing surfaces of the dies, and cylinder means for reciprocating the slidale die in said normal direction into and out of engagement with the overlapped strap portions between the dies, said cylinder means having a cylinder rod connected to the slidable die, said cylinder rod having threaded means extending axially therefrom, means connected to said slidable die threadedly engaging the threaded means extending axially from said cylinder rod, said cylinder rod being axially rotatable for adjusting the spacing of the slidable die with respect to the other die by changing the length of engagement of said threaded means with the means connected to said slidable die, and means for locking said threaded means in position with respect to said cylinder rod, the improvement in said apparatus which comprises:

means for rotating said cylinder rod including a gear wheel secured to said cylinder rod, said gear wheel permitting more accurate adjustment of the spacing of the slidable die with respect to said other die.

2. The improvement of claim 1 wherein said locking means includes means secured to said connecting means and having a portion for selectively engaging the teeth of said gear wheel for locking said gear wheel in position.

* * * * *

UNITED STATES PATENT AND TRADEMARK OFFICE

CERTIFICATE OF CORRECTION

PATENT NO. : 4,739,700

DATED : April 26, 1988

INVENTOR(S) : Brouse, et al.

It is certified that error appears in the above-identified patent and that said Letters Patent is hereby corrected as shown below:

Column 1, Line 38, "overlapping" should be --overlapped--.

Column 1, Line 51, "necessities" should be --necessitates--.

Column 4, Line 28, "moving" should be --removing--.

Column 5, Line 37, "be conventional" should be --be a conventional--.

Signed and Sealed this

Eleventh Day of April, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,739,700
DATED : April 26, 1998
INVENTOR(S) : Brouse et al.

It is certified that error appears in the above-identified patent and that said Letters Patent is hereby corrected as shown below:

Column 1,
Line 38, “overlapping” should be -- overlapped --.
Line 51, “necessities” should be -- necessitates --.

Column 4,
Line 28, “moving” should be -- removing --.

Column 5,
Line 37, “be conventional” should be -- be a conventional --.

Signed and Sealed this

Eighth Day of March, 2005

JON W. DUDAS
*Director of the United States Patent and Trademark Office*